US005333383A

United States Patent [19]

Ferraro

[11] Patent Number: 5,333,383

[45] Date of Patent: Aug. 2, 1994

[54] RAZOR HANDLE MECHANISM WITH CONVEX-CONCAVE SLIDABLE CARTRIDGE SUPPORT

[75] Inventor: Frank A. Ferraro, Trumbull, Conn.

[73] Assignee: Warner-Lambert Company, Morris Plains, N.J.

[21] Appl. No.: 983,014

[22] Filed: Nov. 30, 1992

Related U.S. Application Data

[63] Continuation-in-part of Ser. No. 939,203, Sep. 1, 1992, which is a continuation-in-part of Ser. No. 507,425, Apr. 10, 1990, Pat. No. 5,157,834.

[51] Int. Cl.[5] ..... B26B 21/14

[52] U.S. Cl. ..... 30/87; 30/85; 30/50

[58] Field of Search ..... 30/47, 49, 50, 51, 85, 30/87, 60, 89

[56] References Cited

U.S. PATENT DOCUMENTS

| | | | |
|---|---|---|---|
| Re. 30,913 | 4/1982 | Cartwright et al. . | |
| 3,203,042 | 8/1965 | Craig | 30/85 |
| 3,938,247 | 2/1976 | Carbonell | 30/50 |
| 3,964,159 | 6/1976 | Ferraro | 30/50 |
| 4,069,580 | 1/1978 | Cartwright et al. . | |
| 4,253,236 | 3/1981 | Jacobson | 30/47 |
| 4,266,340 | 5/1981 | Bowman | 30/47 |
| 4,428,116 | 1/1984 | Chen et al. | 30/87 |
| 4,443,939 | 4/1984 | Motta . | |
| 4,459,744 | 7/1984 | Esnard | 30/49 |
| 4,516,320 | 5/1985 | Peleckis . | |
| 4,599,793 | 7/1986 | Iten | 30/85 |
| 4,739,553 | 4/1988 | Lazarchik | 30/47 |
| 4,797,998 | 1/1989 | Motta | 30/85 |
| 4,854,043 | 8/1989 | Chen . | |
| 4,942,662 | 7/1990 | Radcliffe | 30/49 |
| 4,993,154 | 2/1991 | Radcliffe . | |
| 5,027,511 | 7/1991 | Miller | 30/85 |
| 5,031,316 | 7/1991 | Oldroyd | 30/49 |

FOREIGN PATENT DOCUMENTS

| | | |
|---|---|---|
| 1262623 | 11/1989 | Canada . |
| 0300478 | 1/1989 | European Pat. Off. . |
| 300478 | 1/1989 | European Pat. Off. . |
| 2078589 | 1/1982 | United Kingdom . |
| 2086790 | 5/1982 | United Kingdom . |
| 2093750 | 9/1982 | United Kingdom . |
| 2198382 | 6/1988 | United Kingdom . |

*Primary Examiner*—Richard K. Seidel
*Assistant Examiner*—Paul Heyrana
*Attorney, Agent, or Firm*—Charles W. Almer, III

[57] ABSTRACT

A razor handle for movably supporting a flexible, wet-shaving razor unit. The handle includes a cartridge support, operable between a normal position and an advanced position, for providing support to the center of the razor unit during shaving. In the normal position, the razor unit is oriented in a substantially linear configuration, while in the advanced position, the cartridge support is advanced outwards from the housing of the handle mechanism such that the razor unit is oriented in a substantially convex configuration to enhance the shaving of concave body surfaces.

17 Claims, 8 Drawing Sheets

RAZOR HANDLE MECHANISM WITH CONVEX-CONCAVE SLIDABLE CARTRIDGE SUPPORT

This Application is a continuation-in-part of co-pending U.S. patent application Ser. No. 913,203 filed Sep. 1, 1992, which is a continuation in part of Ser. No. 507,425 filed 4/10/90, now U.S. Pat. No. 5,157,834 which issued on Oct. 27, 1992.

BACKGROUND OF THE INVENTION

The present invention is a razor handle and, more particularly, a razor handle with at least one pivotable and flexible attachment member for movably supporting a flexible, wet-shaving razor unit, e.g., a razor cartridge, during shaving.

Many types of razor handles are known in the art. Most modern razor handles are often designed to securably support a disposable cartridge at its ends and midpoint.

Among the various types of razor handles known in the art are the channel-type handles, which typically have two fixed opposing bars adapted to slidably receive a cartridge having a corresponding fixed track. Such channel-type handles provide support to a cartridge along the entire longitudinal length of the cartridge. An example of a cartridge having a fixed track for engagement with a channel-type handle is disclosed in commonly-owned U.S. Pat. No. 4,516,320.

Another type of razor handle known in the art includes spring-actuated engaging members which, upon the application of force to an actuator button, move inward or outward. After the cartridge has been properly positioned on the handle, the actuator button is released, allowing the engaging members to return to their "at rest" position and thereby engage the razor cartridge- Such handles have been designed to either fixedly maintain the cartridge or to allow "pivoting" of the cartridge during shaving. (The term "pivoting" refers to movement of the cartridge about an axis parallel to the blade edge). An improved razor handle which allows the cartridge to pivot or to be locked in a non-pivoting manner is disclosed in commonly-owned U.S. Pat. No. 4,797,998 entitled "Lockable Pivotable Razor."

Today, the use of flexible razor cartridges has become quite common. One early example of such a cartridge is disclosed in U.S. Pat. No. 4,069,580 (which later reissued as U.S. Pat. No. Re. 30,913). This flexible cartridge includes a pair of passages formed in the rear surface of the cartridge which are configured to receive a pair of spaced-apart, rigid pins extending from a handle mechanism. Another example of an early flexible razor is disclosed in commonly-owned U.S. Pat. No. 4,443,939. The '939 patent discloses a flexible cartridge which is also supported by a handle mechanism having extending, spaced-apart, rigid pins. However, the '939 pins are of a relatively short length and are formed with bulbous ends. The rear surface of the cartridge includes a pair of "key-shaped" slots. To load the cartridge onto the handle, the user first positions one of the pins into one of the slots. The user then flexes the cartridge and manipulates the second pin into the second slot. Once the cartridge is released, it returns to its linear configuration, in turn, locking the cartridge onto the handle.

In order to provide a closer shave, a new type of flexible razor cartridge has recently been developed.

This new flexible razor cartridge, disclosed in U.S. Pat. No. 4,854,043, is a flexible cartridge designed to flex along its longitudinal axis during shaving. It will be appreciated by those skilled in the art that when a flexible cartridge flexes along its longitudinal axis, the linear distance between the ends of the cartridge decreases. Because the attachment members of the prior art handles have typically been designed to remain in fixed positions (except, of course, when the cartridge is being attached or detached from the razor handle), such conventional handles would not permit the desired flexing of the flexible-type cartridge or, if such flexing was permitted, would create the risk that the cartridge becomes dislodged from the handle during shaving.

An improved handle is disclosed in commonly-owned co-pending U.S. patent application Ser. No. 600,290 filed on Oct. 15, 1990 in the name of Chen. The Chen handle provides a pair of attachment members for movably supporting a flexible razor cartridge. In other words, the attachment members are designed such that they allow flexing of the razor cartridge. This result is accomplished by designing the attachment members such that they are able to move in response to forces transmitted to them by the flexing cartridge. Additionally, the attachment members may be displaced towards each other by means of an actuator to allow loading of the cartridge on the handle.

Commonly-owned co-pending U.S. patent application Ser. No. 07/507,425 filed on Apr. 10, 1990, discloses an improvement to the Chen handle. More specifically, this co-pending application discloses a handle having a pair of attachment members, an actuator and a slidable cartridge support. The slidable cartridge support provides support to the center of the cartridge during shaving and, additionally, assists in returning the cartridge to its linear configuration after flexing. The structure and operation of the device is intended to stabilize the cartridge during shaving, while remaining easily manipulable during loading and removal of the cartridge.

As mentioned, cartridges of a flexible design have recently been introduced. When loaded onto a handle providing movable support (e.g., the handle described in U.S. patent application Ser. No. 07/507,425), the cartridge is able to flex in response to forces encountered during shaving, thereby enabling the cartridge to conform to the natural contour of the surface being shaved, which, in turn, brings a greater portion of the blade(e) into effective, cutting contact with that surface.

However, even employing the flexible cartridges and handles described above, it may still prove difficult to shave concave body surfaces such as underarms. Accordingly, it would be desirable to provide a handle which movably supports a flexible cartridge to allow shaving of the typical contoured surface encountered during shaving (e.g., a face), but, at the same time, is adaptable to enhance shaving of concave body surfaces such as underarms.

SUMMARY OF THE INVENTION

The present invention is a razor handle for a flexible, wet-shaving razor unit. The handle includes means for movably supporting the razor unit thereon. The supporting means are operable between a supporting position wherein the razor unit is supported for flexing during shaving and a loading position for loading and unloading the razor unit. The handle also includes a cartridge support for providing support to the center of the razor unit during shaving. This cartridge support is operable between a normal position wherein the razor unit is oriented in a substantially linear configuration and an advanced position wherein the razor unit is oriented in a substantially convex configuration to enhance the shaving the concave body surfaces.

The handle preferably includes an actuator connected to the supporting means for moving the supporting means between the supporting position and the loading position. The actuator is biased against the loading position so that the actuator is at rest in a non-biased condition when the supporting means is in the supporting position.

In the preferred embodiment of the present invention, the handle includes a selector dial operatively connected to the cartridge support for operating the cartridge support between the normal position and the advanced position. The handle may also include a detent for locking the selector dial in the advanced position. Additionally, the selector dial is advantageously positioned in a lower shell of the housing of the handle mechanism.

In a preferred embodiment, the selector dial includes a control slot having an arcuate portion which is continuous with and terminates in a linear portion. The cartridge support, in this preferred embodiment, includes an advancing pin engageable with the control slot such that the control pin travels within the control slot when the selector dial is operated. The linear portion of the control slot is preferably aligned with the longitudinal axis when the selector dial is in the normal position. Moreover, the advancing pin is preferably situated in the end of the linear portion proximate the arcuate portion when the selector dial is in the normal position and is also, preferably, free to travel the length of the linear portion in response to flexing of the razor unit.

The handle preferably includes an advancing spring for biasing the cartridge support towards the end of the linear portion proximate the arcuate portion when the selector dial is in the normal position. In this regard, the cartridge support preferably includes a passage for receiving one end of the advancing spring. The preferred embodiment of the present invention also includes at least one spring for biasing the actuator against the loading position.

The supporting means in this preferred embodiment includes two attachment arms each having a pivoting end and a securing end. The pivoting end is pivotably connected to the handle such that the securing end is movable transversely in relation to the longitudinal axis of the handle between maximum displacement from each other in the supporting position and a distance of reduced displacement from each other in the loading position.

The attachment arms of the present invention include means for transversely guiding each of the securing ends in a substantially linear transverse path during operation. Preferably, the means for transversely guiding include a transverse guide slot formed on each of the attachment arms which engages a transverse guide block on the handle to prevent arcuate travel of the securing ends during operation. The means for transversely guiding, in a preferred embodiment, further includes an arm segment proximal the transverse guide slot which permits flexing of each of the attachment arms to accommodate linear transverse travel during operation. Preferably, the arm segments include at least one reduced body section sufficient to permit repeated bending of the attachment arm without breaking during operation.

Accordingly, the present invention provides a handle capable of movably supporting a flexible, wet-shaving razor unit to allow shaving of the typical contoured surfaces encountered during shaving (e.g., a face). This same razor handle is additionally capable of "bowing" the razor unit into a convex configuration, thereby enhancing the ability of the user to shave concave body surfaces such as underarms. Once the user has completed the shaving of the concave body surface, the selector dial is again rotated to allow the flexible razor unit to return to its normal linear configuration.

DETAILED DESCRIPTION OF THE INVENTION

Figure 1:
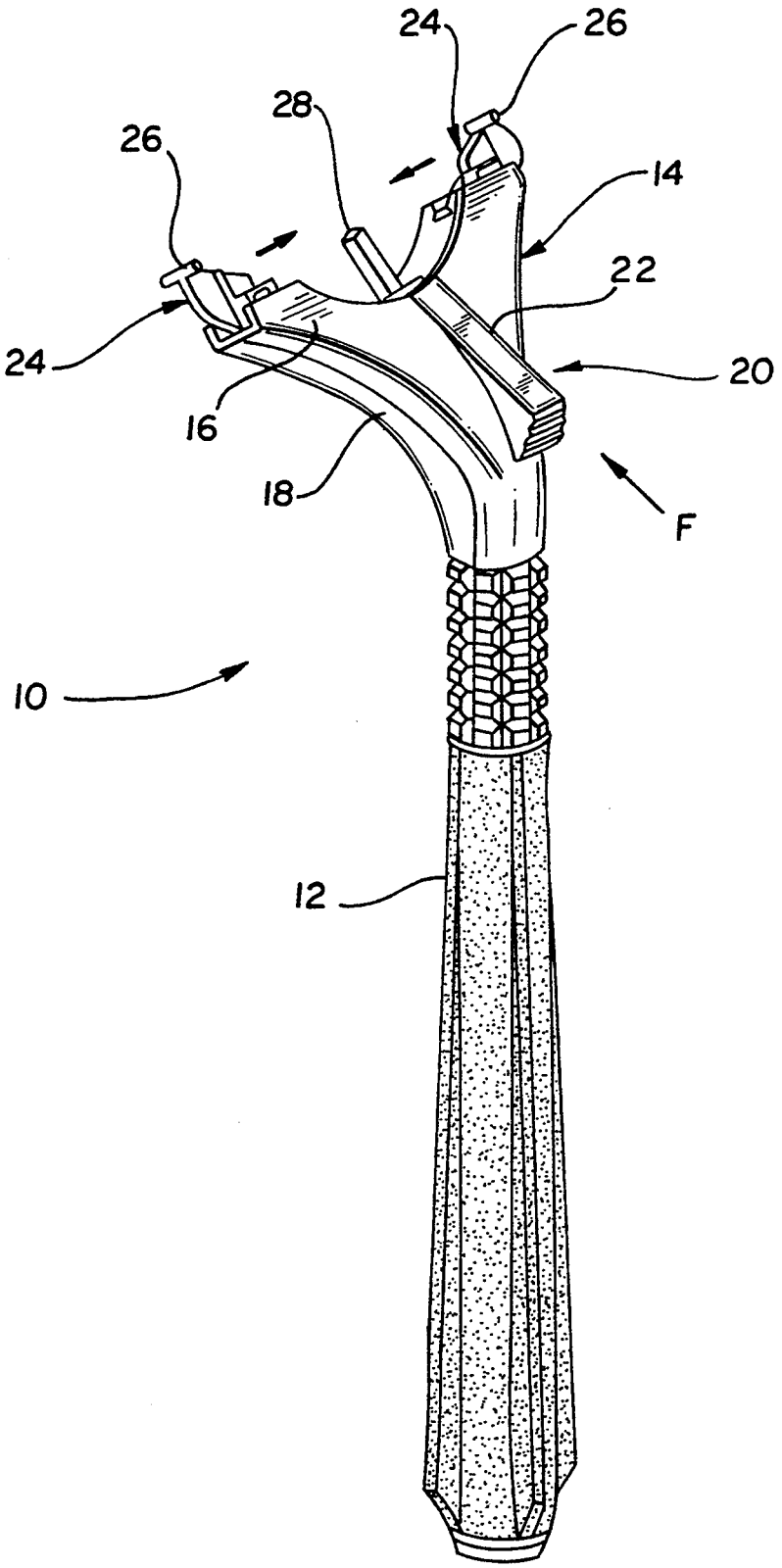
FIG. 1 is a perspective view of a razor handle according to the present invention.

Referring to the drawings, a razor handle 10 is illustrated in FIG. 1. Handle 10 includes a unitary shaft portion 12 joined to a housing 14, which houses the mechanism of the present invention. Housing 14 is defined by an upper shell 16 and a lower shell 18.

The mechanism of the present invention includes actuator 20 (best seen in FIG. 6) having an operating projection, i.e., push button 22. Push button 22 extends outward through a rectangular opening in upper shell 16. The mechanism also includes a pair of attachment arms 24 having securing pins 26. Additionally, the mechanism includes a slidable cartridge support 28.

Actuator 20 is operatively connected to attachment arms 24. More particularly, by applying a force F to push button 22, actuator 20 is displaced along the direction of the line of force, i.e., along longitudinal axis L (as defined in FIG. 7).

Figure 2:
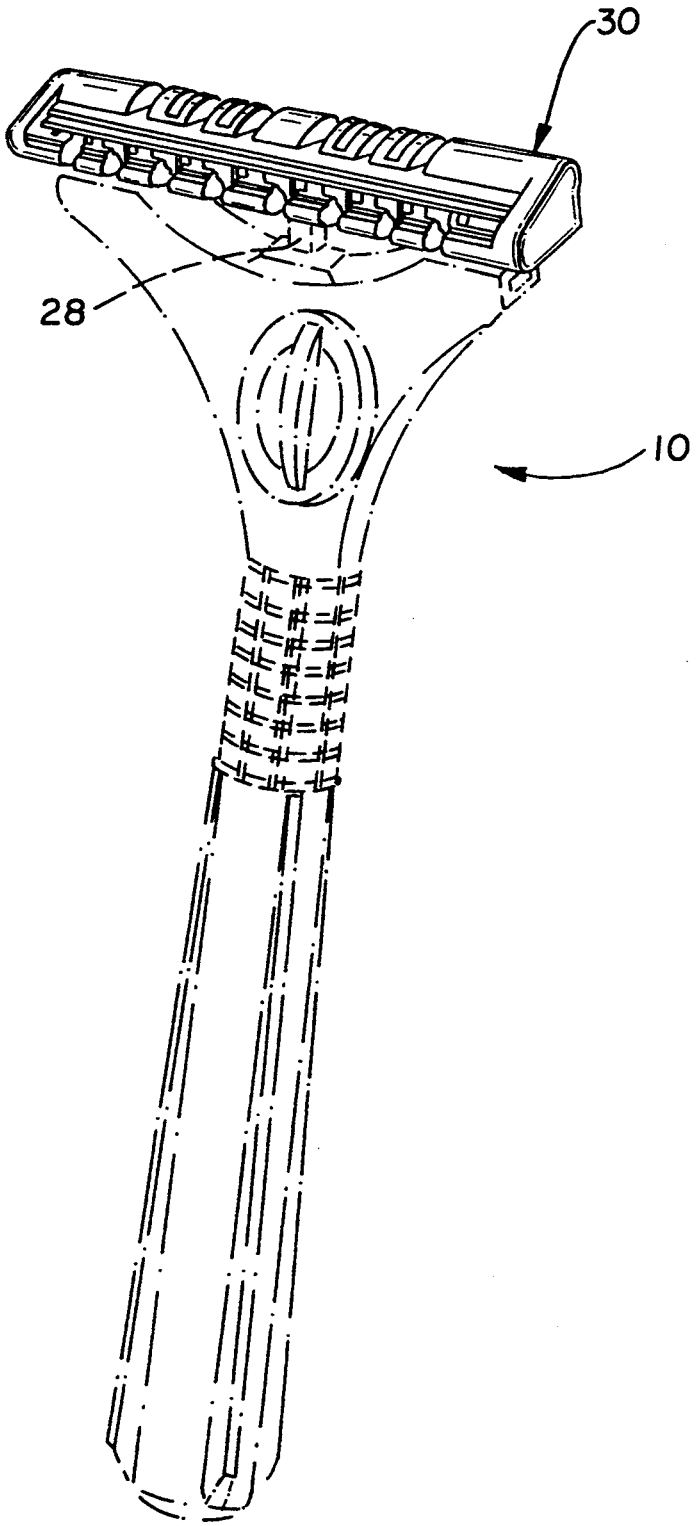
FIG. 2 is a perspective view of a razor handle with a flexible, wet-shaving razor unit positioned thereon.

FIG. 2 shows a flexible wet-shaving razor unit, i.e., cartridge 30, secured to handle 10. Cartridge 30 is centrally supported by a slidable cartridge support 28, which is described more fully below. As shown in FIG. 2, cartridge 30 is oriented in a generally linear configuration. Cartridge support 28, which provides support to the center of the cartridge, also assists in returning the cartridge to its linear configuration after flexing.

Figure 3:
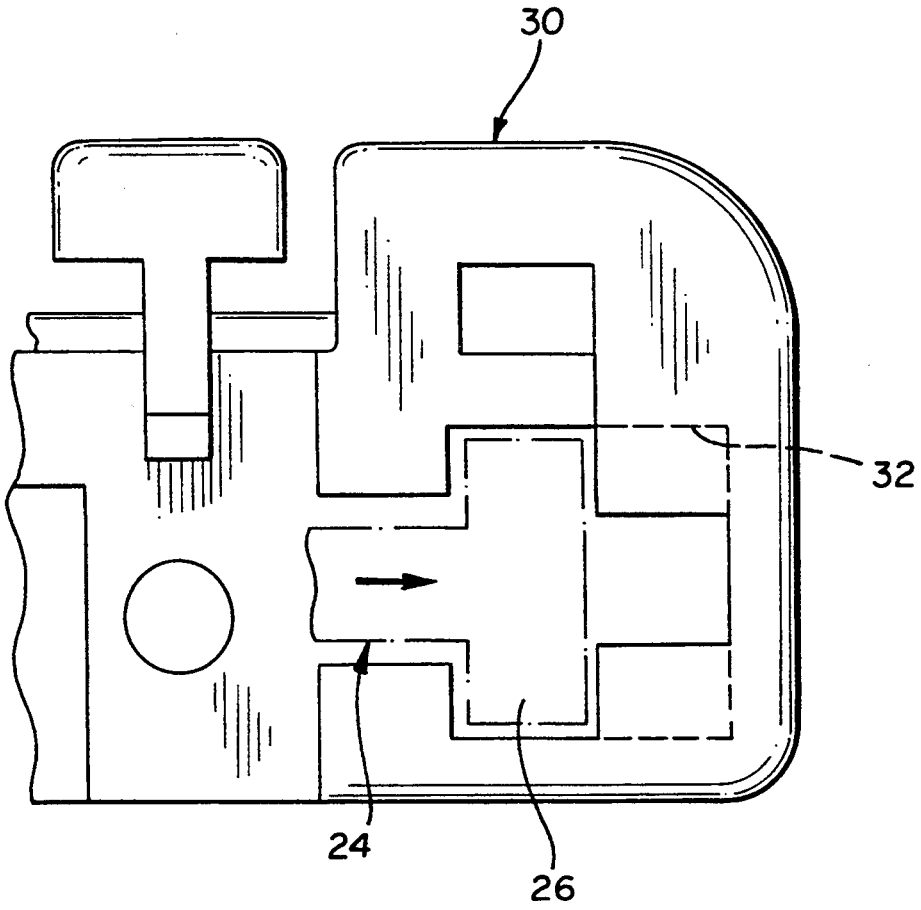
FIG. 3 is an enlarged detail of the razor unit illustrating the partially-enclosed cavity that receives the attachment member of the present invention.

As noted above, attachment members 24 may be actuated inwardly. This movement is necessary to enable the user to load cartridge 30 onto the handle. Referring to FIG. 3, cartridge 30 is formed with a pair of opposing partially-recessed cavities 32 in its bottom surface. When attachment members 24 are actuated inwardly, securing pins 26 align themselves with a pair of enlarged openings in cavities 32, thereby allowing attachment members 24 to be inserted into the cavities. At this point, the force on the actuator is released, which, in turn, allow the attachment members 24 to expand outwardly, i.e., they return to their original non-biased position. As is apparent from FIG. 3, the outward movement of attachment members 24 will force securing pins 26 into the enclosures of cavities 32, thereby locking the cartridge onto the handle. To remove the cartridge from the handle, the attachment members are again actuated inwardly to align securing pins 26 with the enlarged openings in cavities 32. This alignment permits the cartridge to be removed from the handle.

Figure 4:
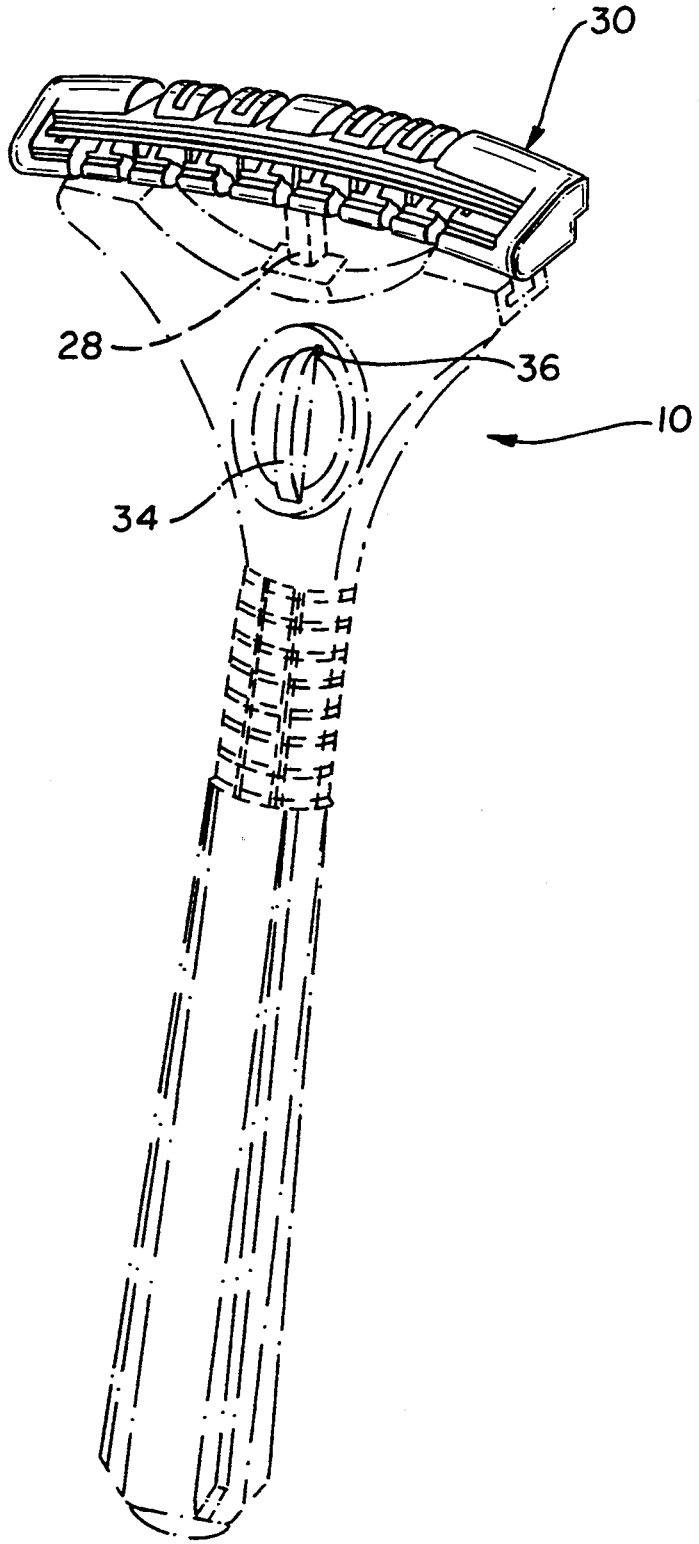
FIG. 4 is a perspective view of the razor handle with a flexible, wet-shaving razor unit positioned thereon and flexed into the convex configuration for shaving concave body surfaces.

Referring to FIG. 4, cartridge 30 is shown in a convex configuration, that is, the cartridge is bowed outwardly, away from the housing. In the bowed configuration, the cartridge is particularly suited for shaving concave body surfaces such as underarms.

In detail, this outward bowing of the cartridge is accomplished by means of selector dial 34, which is operatively connected to cartridge support 28. Cartridge support 28 is operable in two positions: 1) a normal position (as shown in FIG. 2) wherein the cartridge is oriented in a substantially linear configuration which permits flexing of the cartridge in response to forces encountered during shaving; and 2) an advanced position (as shown in FIG. 4) wherein the cartridge is oriented in a substantially convex configuration which enhances shaving of concave body surfaces such as underarms. In the advanced configuration, the cartridge is maintained substantially rigid (i.e., flexing is not allowed). Hence, a rotation of selector dial 34 shifts handle mechanism 10 between a "normal position" and an "advanced position" in which cartridge support 28 is advanced from housing 14, thereby causing cartridge 30 to bow outwardly.

Selector dial 34 is preferably provided with a detent 36 to allow the dial to be "locked" into the advanced position once the cartridge support is advanced outwards. To return the handle to the normal position, the user simply disengages the dial from the detent, and then rotates the dial in the appropriate direction such that the cartridge support is withdrawn into the housing.

Figure 5:
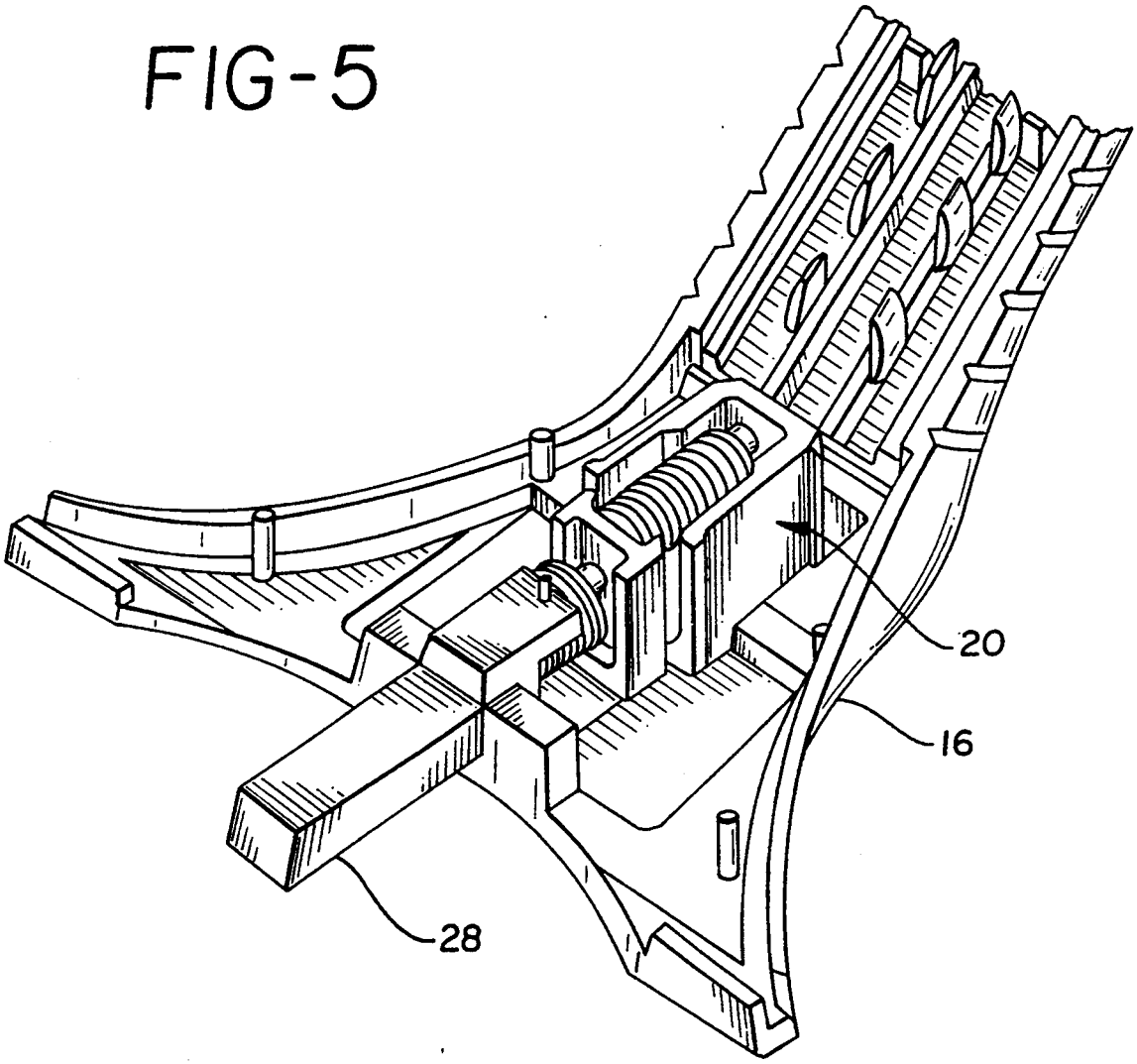
FIG. 5 is a bottom perspective view of the razor handle of the present invention with the lower shell of the housing removed for clarity.
Figure 6:
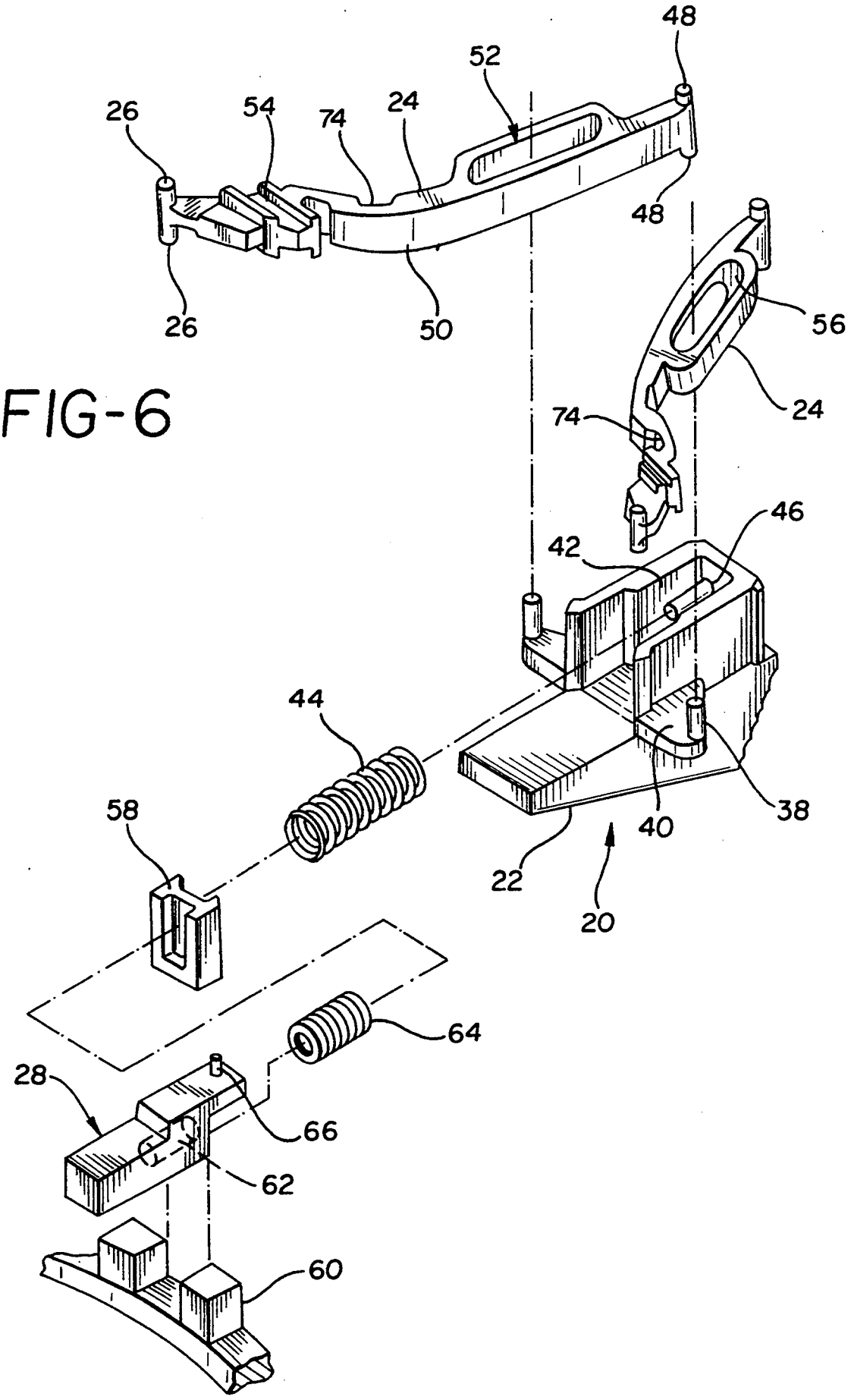
FIG. 6 is an exploded view of the components of the razor handle illustrated in FIG. 5.

The components included in handle 10 are shown in their assembled state in FIG. 5 and, again, in an exploded format in FIG. 6. The operation of attachment members 24 and actuator 20 is described in detail in commonly-owned copending U.S. patent application Ser. No. 07/507,425 filed on Apr. 10, 1990, incorporated herein by reference. Accordingly, the operation of these components will be discussed only briefly below.

Actuator 20, as best shown in FIG. 6, includes a pair of camming pins 38. Camming pins 38 are advantageously disposed at the ends of lateral wing extensions 40, which extend away from longitudinal axis L (shown in FIG. 7). Actuator 20 also includes a channel 42 dimensioned to surround a biasing spring 44. A spring retaining pin 46 is disposed at the end of channel 42.

Attachment arm 24 includes securing pins 26. Attachment arm 24 also includes pivot pins 48. An arm segment 50 and a slot 52 are disposed between securing pins 26 and pivot pins 48. Attachment arm 24 additionally includes transverse guide slot 54.

Slot 52 includes an inside camming surface 56. The slot may be formed with a surrounding chamfered edge. Alternatively, the slot may be formed such that it does not extend fully through the attachment arm.

Actuator 20 is rearwardly biased by spring 44, that is, actuator 20 is forced in a direction along longitudinal axis L away from slidable cartridge support 28. This position may be referred to as the "non-biased position" or "supporting position." In other words, the actuator is biased against the loading position. Spring 44, which biases actuator 20, is secured in channel 42 by means of spring retaining pin 46. The other end of spring 44 rests against spring retainer 58, which is fixedly connected to housing 14.

Cartridge support 28 is configured to slide between a pair of guide posts 60, which are also fixedly connected to housing 14. Cartridge support 28 may include a spring passage 62 for receiving one end of a cartridge advancing spring 64. The other end of the cartridge advancing spring rests against the other side of spring retainer 58. Finally, cartridge support 28 includes an advancing pin 66 which engages a control slot 68 formed in selector dial 34.

Figure 7:
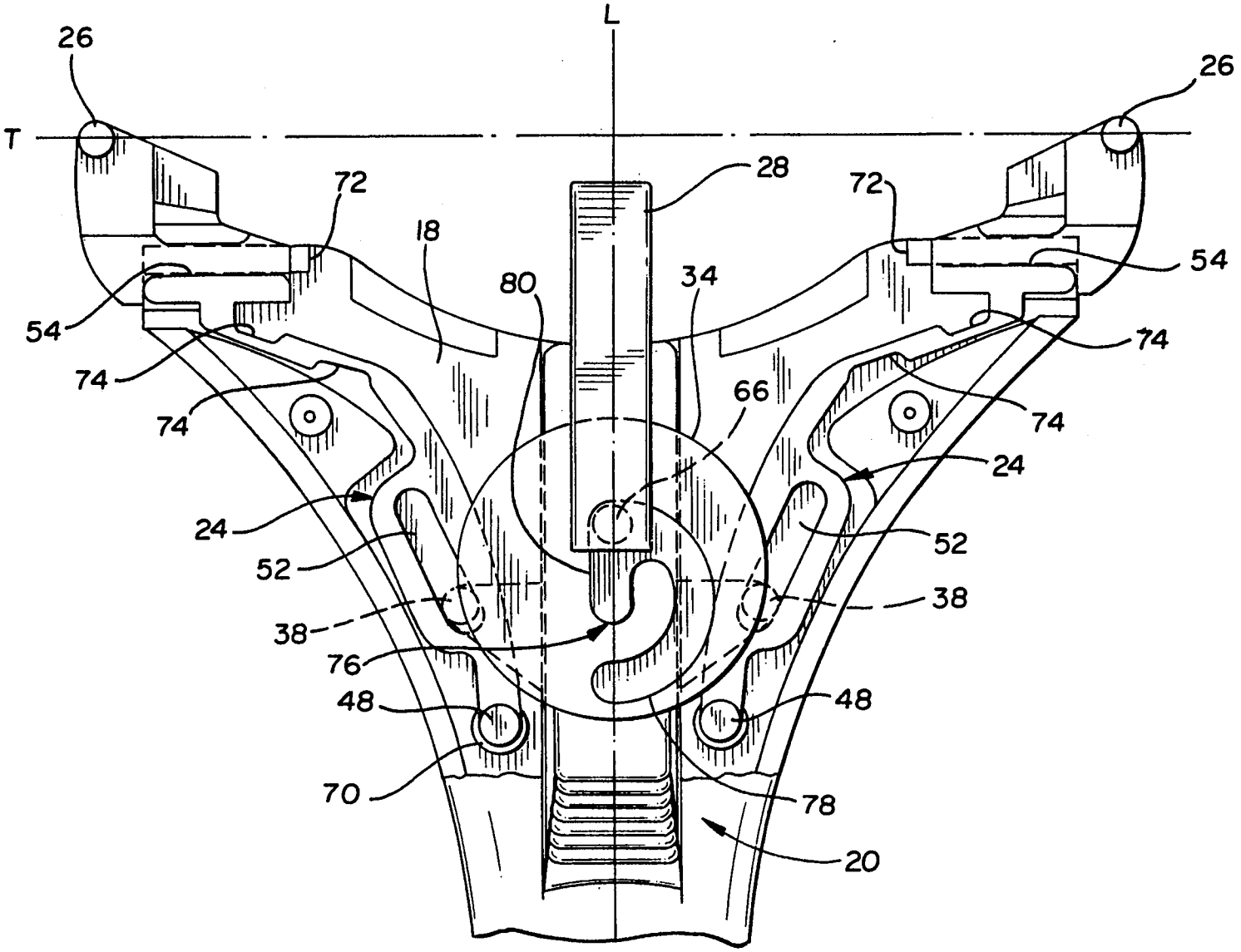
FIG. 7 is a top plan view of the razor handle with the upper shell of the housing removed for clarity and with the selector dial in the normal operating position.

As seen from reference to FIG. 7, pivot pins 48 are received by pivot holes 70 in lower shell 18. Pivot pins 48 are also received by similar pivot holes (not shown) in upper shell 16 (also not shown). Transverse guide slots 54 of attachment arms 24 receive transverse guide blocks 72. Because of the tight tolerance between the transverse guide slots and the transverse guide blocks, securing pins 26 will travel along a transverse path (i.e., along transverse axis T shown in FIG. 7) substantially perpendicular to longitudinal axis L when the attachment arms are actuated.

Even though attachment arm 24 is pivotably linked to lower shell 18, this "horizontal" movement of securing pins 26 is allowed and is accomplished because arm segment 50 is designed to flex as a living hinge at reduced body sections or notches 74. These notches are sufficient to permit repeated bending of the attachment arms without breaking during operation. This movement, however, will only be accomplished when actuator 20 has been translated forward to the extent that camming pin 38 has travelled into the forward portion of slot 52. In particular, as camming pin 38 travels into the forward portion of slot 52, the attachment arms are forced to pivot about pins 48 towards longitudinal axis L.

As a consequence, securing pins 26 travel along transverse axis T. Securing pins 26 would normally travel towards axis L along an arcuate path; however, because of transverse guide slots 54 and transverse guide blocks 72, securing pins 26 travel transversely toward longitudinal axis L. As previously noted, this deviation from the expected path is produced by allowing arm segment 52 to flex about notches 74.

The operation of selector dial 34 may be readily explained with reference to FIG. 7–8. As shown, control slot 76 has an arcuate portion 78 terminating in a linear portion 80. When cartridge support 28 is in the normal position, advancing pin 66 is situated in the linear portion 80 for free travel back and forth therein, as shown in FIG. 7. Cartridge support 28 is forwardly biased by cartridge advancing spring 64. In the normal position, the razor unit is free to flex because cartridge support 28 is able to travel along longitudinal axis L in response to forces exerted during shaving. More particularly, cartridge support 28 is free to travel because advancing pin 66 is free to travel within linear portion 80. In effect, cartridge support 28—in this normal position—operates in the same manner as does the cartridge support disclosed in U.S. patent application Ser. No. 07/507,425.

Figure 8:
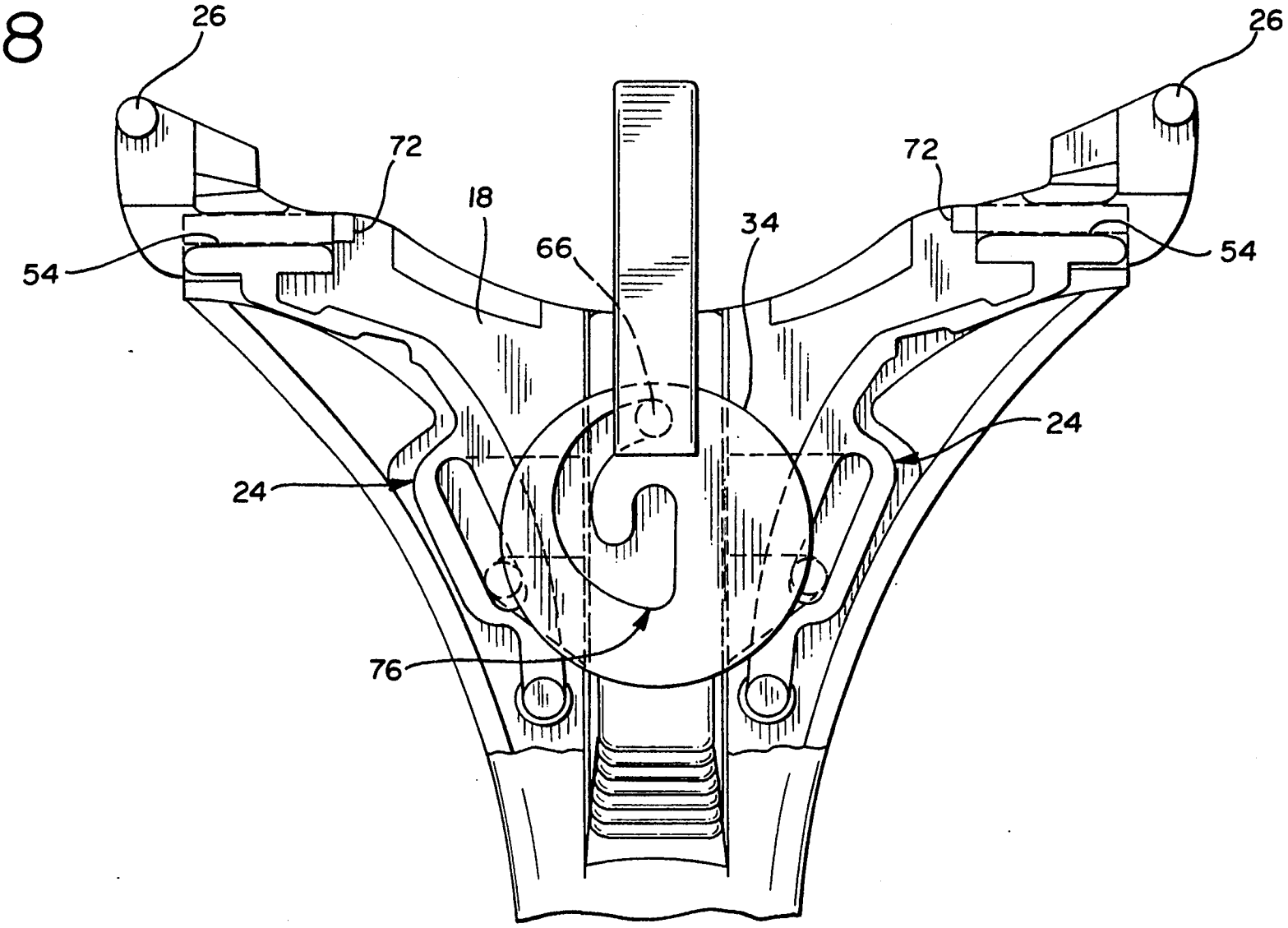
FIG. 8 is a top plan view of the razor handle with the upper shell of the housing removed for clarity and with the selector dial in the advanced position.

The advantages afforded by the present invention are realized by turning selector dial 34 counter-clockwise (or clockwise, depending on the orientation of the control slot) until the dial is situated as shown in FIG. 8. In this position, advancing pin 66 is situated in the arcuate tip of arcuate portion 78. It is readily apparent that by rotating selector dial 34 from the normal position to the advanced position, cartridge support 28 will be advanced outwardly.

In a preferred embodiment of the present invention, this advancement of cartridge support 28 is on the order of 0.05 inches, which is enough to cause razor unit 30 to bow outwardly (i.e., into a convex configuration), thereby enhancing the ability of the razor unit to shave concave body surfaces.

In this advanced position, the razor unit is maintained substantially rigid (i.e., flexing is not allowed). Once the user has completed shaving the concave body surface, the selector dial is disengaged from detent 36 and returned to the normal position, which, in turn, withdraws the cartridge support into the housing and allows the razor unit to return to its normal linear configuration.

While there have been described what are presently believed to be the preferred embodiments of the invention, those skilled in the art will realize that various changes and modifications may be made to the invention without departing from the spirit of the invention, and is intended to claim all such changes and modifications as fall within the scope of the invention.

What is claimed is:

1. A razor handle for a flexible, wet-shaving razor unit comprising:

means for movably supporting said razor unit on said handle, said supporting means operable between a supporting position wherein said razor unit is supported for flexing during shaving and a loading position for loading and unloading said razor unit;

a cartridge support providing support to the center of said razor unit during shaving, said cartridge support operable between a normal position wherein said razor unit is oriented in a substantially linear configuration and an advanced position wherein said razor unit is oriented in a substantially convex configuration to enhance the shaving of concave body surfaces; and a selector dial operatively connected to said cartridge support for operating said cartridge support between said normal position and said advanced position;

wherein said selector dial comprises a control slot having an arcuate portion and a linear portion, said arcuate portion continuous with and terminating in said linear portion; and wherein said cartridge support includes an advancing pin engageable with said control slot such that said control pin travels within said control slot when said selector dial is operated.

2. The razor handle according to claim 1, further comprising an actuator connected to said supporting means for moving said supporting means between said supporting position and loading position, said actuator biased against said loading position so that said actuator is at rest in a non-biased condition when said supporting means is in said supporting position.

3. The razor handle according to claim 1, wherein said razor unit is maintained substantially rigid when said cartridge support is in said advanced position.

4. The razor handle according to claim 1, wherein said cartridge support is advanced on the order of 0.05 inches when moved from said normal position to said advanced position.

5. The razor handle according to claim 1, further comprising a detent for locking said selector dial in said advanced position.

6. The razor handle according to claim 1, further comprising a housing having a lower shell and an upper shell, said selector dial being positioned in said lower shell.

7. The razor handle according to claim 1, wherein said linear portion of said control slot is aligned with said longitudinal axis when said selector dial is in said normal position; and wherein said advancing pin is situated in said linear portion when said selector dial is in said normal position whereby said pin is free to travel the length of said linear portion in response to flexing of said razor unit.

8. The razor handle according to claim 7, further comprising an advancing spring for biasing said cartridge support towards the end of said linear portion when said selector dial is in said normal position.

9. The razor handle according to claim 8, wherein said cartridge support includes a passage for receiving one end of said advancing spring.

10. The razor handle according to claim 1, further comprising at least one spring for biasing said actuator against said loading position.

11. The razor handle according to claim 1, wherein said supporting means includes two attachment arms, each of said attachment arms having a pivoting end and a securing end, each of said pivoting ends being pivotably connected to said handle and each of said securing ends being moveable transversely in relation to the longitudinal axis of said handle between maximum displacement from each other in said supporting position and a distance of reduced displacement from each other in said loading position.

12. The razor handle according to claim 11, wherein each of said attachment arms further comprises means for transversely guiding each of said securing ends in a substantially linear transverse path during operation.

13. The razor handle according to claim 12, wherein said means for transversely guiding comprises a transverse guide slot formed on each of said attachment arms which engages a transverse guide block on said handle to prevent arcuate travel of said securing ends during operation.

14. The razor handle according to claim 13, wherein said means for transversely guiding further comprises an arm segment proximal said transverse guide slot which permits flexing of each of said attachment arms to accommodate linear transverse travel during operation.

15. The razor handle according to claim 14, wherein said arm segment comprises at least one reduced body section sufficient to permit repeated bending of said attachment arm without breaking during operation.

16. The razor handle according to claim 11, wherein each of said securing ends comprises a pair of opposing securing pins for engagement with cavities located on said razor unit.

17. The razor handle according to claim 1, wherein said actuator comprises an operating projection which extends outward from the surface of said handle for operational access by the user.

* * * * *